US011242729B2

(12) United States Patent
Vasques

(10) Patent No.: US 11,242,729 B2
(45) Date of Patent: Feb. 8, 2022

(54) EXPANSION ASSEMBLY

(71) Applicant: Welltec Oilfield Solutions AG, Zug (CH)

(72) Inventor: Ricardo Reves Vasques, Allerød (DK)

(73) Assignee: WELLTEC OILFIELD SOLUTIONS AG, Zug (CH)

( * ) Notice: Subject to any disclaimer, the term of this patent is extended or adjusted under 35 U.S.C. 154(b) by 0 days.

(21) Appl. No.: 16/341,416

(22) PCT Filed: Oct. 11, 2017

(86) PCT No.: PCT/EP2017/075882
§ 371 (c)(1),
(2) Date: Apr. 11, 2019

(87) PCT Pub. No.: WO2018/069366
PCT Pub. Date: Apr. 19, 2018

(65) Prior Publication Data

US 2019/0264537 A1 Aug. 29, 2019

(30) Foreign Application Priority Data

Oct. 12, 2016 (EP) ..... 16193476
Jun. 9, 2017 (EP) ..... 17175232

(51) Int. Cl.
*E21B 33/127* (2006.01)
*E21B 34/10* (2006.01)
*E21B 43/10* (2006.01)

(52) U.S. Cl.
CPC ..... *E21B 34/10* (2013.01); *E21B 33/1272* (2013.01); *E21B 43/105* (2013.01); *E21B 2200/06* (2020.05)

(58) Field of Classification Search
CPC ..... E21B 33/1272; E21B 43/105
(Continued)

(56) References Cited

U.S. PATENT DOCUMENTS 4,828,037 A * 5/1989 Lindsey ..... E21B 23/04 166/212
7,017,670 B2 3/2006 Hazel et al.
(Continued)

FOREIGN PATENT DOCUMENTS

| | | |
|---|---|---|
| EP | 2 818 631 | 12/2014 |
| GB | 2526596 | 12/2015 |
| WO | 2010/136806 | 12/2010 |

OTHER PUBLICATIONS

International Search Report and Written Opinion of the ISA for PCT/EP2017/075882 dated Feb. 8, 2018, 14 pages.
(Continued)

*Primary Examiner* — Taras P Bemko
(74) *Attorney, Agent, or Firm* — Nixon & Vanderhye P.C.

(57) ABSTRACT

The present invention relates to a drill pipe expansion assembly (1) for expansion of a completion component (3) located at a fixed position in a well (4) having a longitudinal axis (5), the drill pipe expansion assembly comprising an expansion unit (6) which is moveable in relation to the completion component comprising a tubular element (7) comprising a first end (8) and a second end (10) and a wall (11) having an outer face (12) and an outlet (14) for ejection of pressurised fluid, and a first sealing element (15,15*a*) and a second sealing element (15, 15*b*) arranged on the outer face on each side of the outlet, and a positioning unit (20) comprising a body (21) and a first fixation element (22) movable between a projected position and a retracted position in relation to the body, the positioning unit being connected with the tubular element in order to maintain the expansion unit in a fixed position in relation to the completion component (3) during expansion. The present invention further relates to a downhole system.

18 Claims, 10 Drawing Sheets

Figure 1:
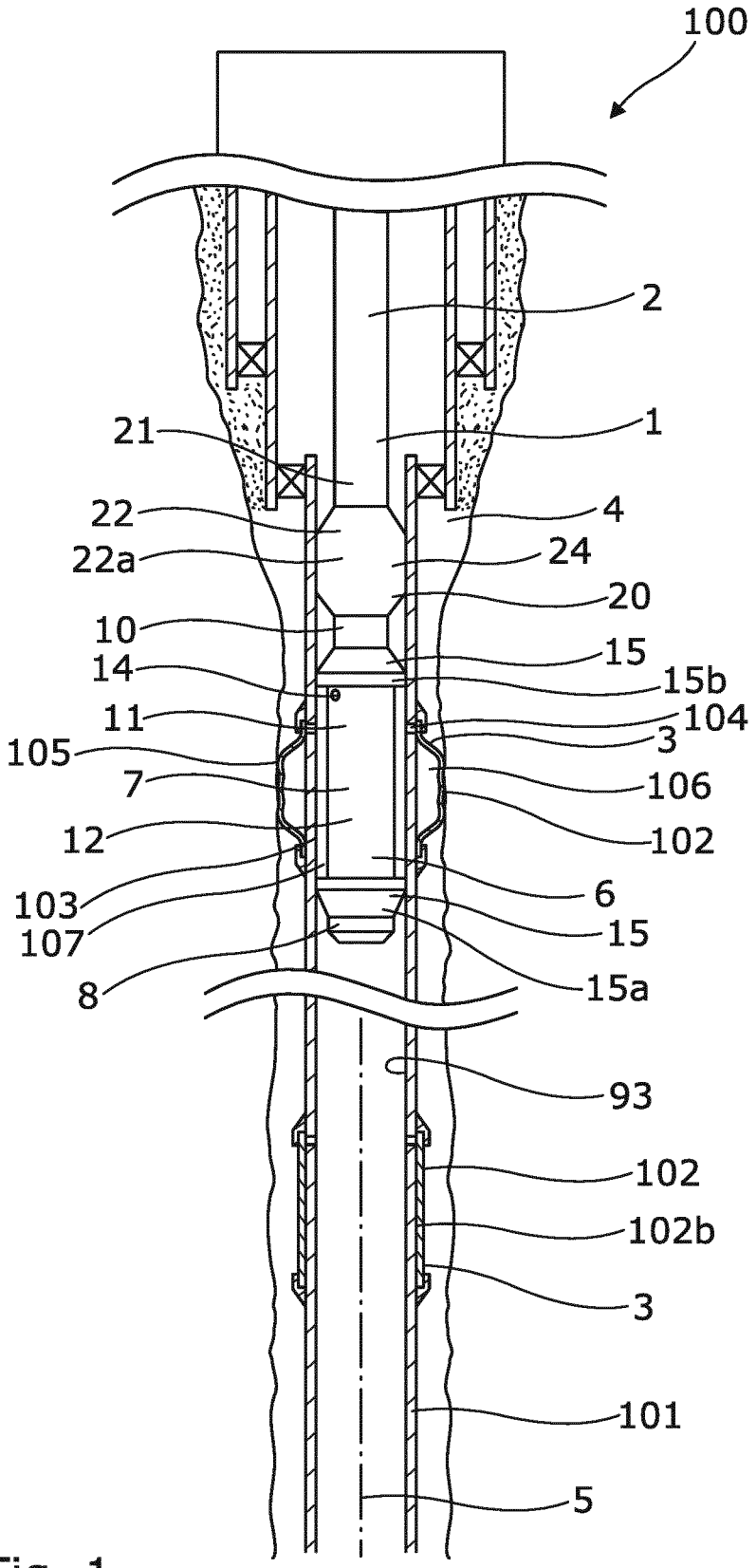

(58) Field of Classification Search
USPC ..... 166/179
See application file for complete search history.

(56) References Cited

U.S. PATENT DOCUMENTS

| | | | | |
|---|---|---|---|---|
| 2004/0069496 | A1 | 4/2004 | Hosie et al. | |
| 2004/0108109 | A1* | 6/2004 | Allamon | E21B 23/04 166/243 |
| 2014/0311751 | A1 | 10/2014 | Hallundbæk et al. | |
| 2015/0027725 | A1* | 1/2015 | Adam | E21B 34/14 166/373 |
| 2015/0345249 | A1* | 12/2015 | Gorrara | E21B 33/127 166/387 |
| 2016/0130919 | A1* | 5/2016 | Vasques | F04B 47/02 166/381 |
| 2018/0087335 | A1* | 3/2018 | Weckend | E21B 47/09 |

OTHER PUBLICATIONS

Extended Search Report for EP16193476.5 dated Jan. 9, 2017, 10 pages.
Communication Pursuant to Article 94(3) EPC dated May 28, 2021 in European Application No. 17 783 476.9, 7 pages.

* cited by examiner

EXPANSION ASSEMBLY

This application is the U.S. national phase of International Application No. PCT/EP2017/075882 filed Oct. 11, 2017 which designated the U.S. and claims priority to EP Patent Application No. 16193476.5 filed Oct. 12, 2016 and EP Patent Application No. 17175232.2 filed Jun. 9, 2017, the entire contents of each of which are hereby incorporated by reference.

The present invention relates to a drill pipe expansion assembly for expansion of a completion component located at a fixed position in a well and to a downhole system.

When expanding a completion component in a well using sealing cups to seal off a zone in order to pressurise that zone, the cups are often damaged to such an extent after only one run that they have to be replaced by new cups before the expansion of another completion component can take place. This replacement of cups between two runs is time-consuming and expensive.

It is an object of the present invention to wholly or partly overcome the above disadvantages and drawbacks of the prior art. More specifically, it is an object to provide an improved expansion assembly where the sealing elements do not have to be replaced between two successive expansions of a completion component.

The above objects, together with numerous other objects, advantages and features, which will become evident from the below description, are accomplished by a solution in accordance with the present invention by an expansion assembly for connection with a drill pipe for expansion of a completion component in a well having a longitudinal axis, the expansion assembly comprising:

an expansion unit comprising:

- a tubular element comprising a first end and a second end and a wall having an outer face and an outlet for ejection of pressurised fluid, and
- a first sealing element and a second sealing element arranged on the outer face on each side of the outlet, and a positioning unit comprising a body and a first fixation element movable between a projected position and a retracted position in relation to the body, the positioning unit being connected with the second end of the tubular element in order to maintain the expansion unit in a position during expansion.

In addition, a completion component may be located at a fixed position in the well.

Furthermore, the expansion unit may be moveable in relation to the completion component.

Also, the positioning unit may be connected with the tubular element in order to maintain the expansion unit in a fixed position in relation to the completion component during expansion.

The above objects, together with numerous other objects, advantages and features, which will become evident from the below description, are accomplished by a solution in accordance with the present invention by a drill pipe expansion assembly for expansion of a completion component located at a fixed position in a well having a longitudinal axis, the drill pipe expansion assembly comprising:

an expansion unit which is moveable in relation to the completion component, comprising:

- a tubular element comprising a first end and a second end and a wall having an outer face and an outlet for ejection of pressurised fluid, and

- a first sealing element and a second sealing element arranged on the outer face on each side of the outlet, and a positioning unit comprising a body and a first fixation element movable between a projected position and a retracted position in relation to the body, the positioning unit may be connected with the tubular element in order to maintain the expansion unit in a fixed position in relation to the completion component during expansion.

The positioning unit may be fluidly connected with the drill pipe and pressurised fluid in the drill pipe may be supplied to the positioning unit in order to move the fixation element from the retracted position to the projected position.

In addition, the positioning unit may be fluidly connected with the tubular element.

Also, the positioning unit may be fluidly connected with the outlet of the expansion unit.

Moreover, the positioning unit may be fluidly connected with the outlet through a fluid channel in the wall.

Furthermore, the positioning unit may be a sleeve operating unit having projectable elements with a profile configured to engage a profile in a sleeve.

Additionally, the positioning unit may be arranged in between the first sealing element and the second sealing element.

Further, the expansion unit may have a first opening in the first end, said first opening being in fluid communication with the second opening in an end part arranged between the second end and the second sealing element.

In addition, the positioning unit may comprise a second fixation element arranged opposite the first fixation element.

Said fixation element may be a projectable element.

Also, the fixation element may be an inflatable element.

Furthermore, the sealing elements may be cup seals.

Further, the expansion unit may comprise two first sealing elements and two second sealing elements.

The expansion assembly according to the present invention may further comprise a ball catching unit having a first end and a second end, the first end of the ball catching unit being connected to the positioning unit and the second end of the ball catching unit being connected to the drill pipe.

Moreover, the ball catching unit may comprise a ball seat.

Also, the ball catching unit may further comprise a fluid bypass channel which is in fluid communication with the positioning unit, so that the pressurised fluid bypasses the ball seat.

The ball catching unit may further comprise an aperture between the ball seat and the positioning unit.

Further, the ball catching unit may have a bore between the aperture and the second end of the ball catching unit.

In addition, the ball catching unit may further comprise a sliding sleeve comprising the ball seat and being arranged within the bore.

Moreover, an annular cavity may be arranged between the bore and the sliding sleeve, in which annular cavity a spring is arranged, the sliding sleeve having a projection for compressing the spring as the sliding sleeve moves towards the aperture.

Furthermore, the ball seat may be constituted by several pins projecting radially inwards.

The ball catching unit may have a first recess configured to receive the pins as the sliding sleeve moves towards the aperture.

Also, the ball catching unit may comprise a second ball seat constituted by several pins projecting radially inwards as the sliding sleeve moves towards the aperture, and the ball catching unit further comprises a second recess configured to receive the pins of the second ball seat as the sliding sleeve moves away from the apertures.

Moreover, the recess may have an inclined face for moving the pins radially inwards.

The present invention also relates to an expansion assembly for connection with a drill pipe for expansion of a completion component in a well having a longitudinal axis, the expansion assembly comprising:

an expansion unit comprising:

a tubular element comprising a first end and a second end and a wall having an outer face and an outlet for ejection of pressurised fluid, and a first sealing element and a second sealing element arranged on the outer face on each side of the outlet, and a ball catching unit having a first end and a second end, the first end of the ball catching unit being connected to the expansion unit and the second end of the ball catching unit being connected to the drill pipe.

The expansion assembly according to the present invention may further comprise a pump and a motor powered through wireline.

Moreover, the sliding sleeve may have a sleeve bore having an inner diameter which is larger than an outer diameter of the ball.

Also, the present invention relates to a downhole system comprising:

a well tubular structure, at least two annular barriers, each annular barrier comprising:

a tubular part having an expansion opening and mounted as part of the well tubular structure, an expandable sleeve surrounding and connected with the tubular part, and an expandable space between the expandable sleeve and the tubular part, the expandable sleeve being expandable when pressurised fluid is let in through the expansion opening into the expandable space, and an expansion assembly according to any of the preceding claims arranged in the well tubular structure, so that the first sealing element and the second sealing element are arranged on opposing sides of the expansion opening to provide an annular space which is pressurised with pressurised fluid for expanding the expandable sleeve.

The expansion assembly may further comprise a driving unit/downhole tractor.

In addition, the positioning unit may be a driving unit/downhole tractor.

The present invention also relates to an expansion method for expansion of an annular barrier, comprising:

connecting an expansion assembly according to any of the preceding claims with a drill pipe, arranging the expansion assembly in a well tubular structure, pressurising fluid in the drill pipe, letting the pressurised fluid into the positioning unit to project the fixation element of the positioning unit, and letting the pressurised fluid into the expansion unit and out through the outlet in the wall.

Said expansion method may further comprise connecting a ball catching unit between the drill pipe and the positioning unit.

Moreover, the expansion method may comprise:

dropping a ball, landing the ball in a ball seat of a sliding sleeve of the ball catching unit, and moving the sliding sleeve in a bore in a first direction for compressing a spring.

The ball seat may be constituted by a plurality of pins which engage a first recess when the sliding sleeve moves and the ball moves further to engage a second ball seat constituted by pins.

The expansion method as described above may further comprise:

releasing the pressure, moving the sliding sleeve in a second direction opposite the first direction by means of the spring, engaging a second recess by means of the pin of the second ball seat, disengaging the ball, moving the ball further in the first direction, and catching the ball in a ball catching chamber.

Further, the present invention relates to an expansion method for expansion of an annular barrier, said method comprising:

arranging an expansion assembly according to any of the preceding claims in a well tubular structure having an annular barrier, so that the first sealing element and the second sealing element are arranged on opposing sides of an expansion opening of the annular barrier to provide an annular space therebetween, which annular space is pressurised with pressurised fluid for expanding an expandable sleeve of the annular barrier, and ejecting pressurised fluid through the outlet of the tubular element of the expansion assembly in order to expand the annular barrier.

Figure 2:
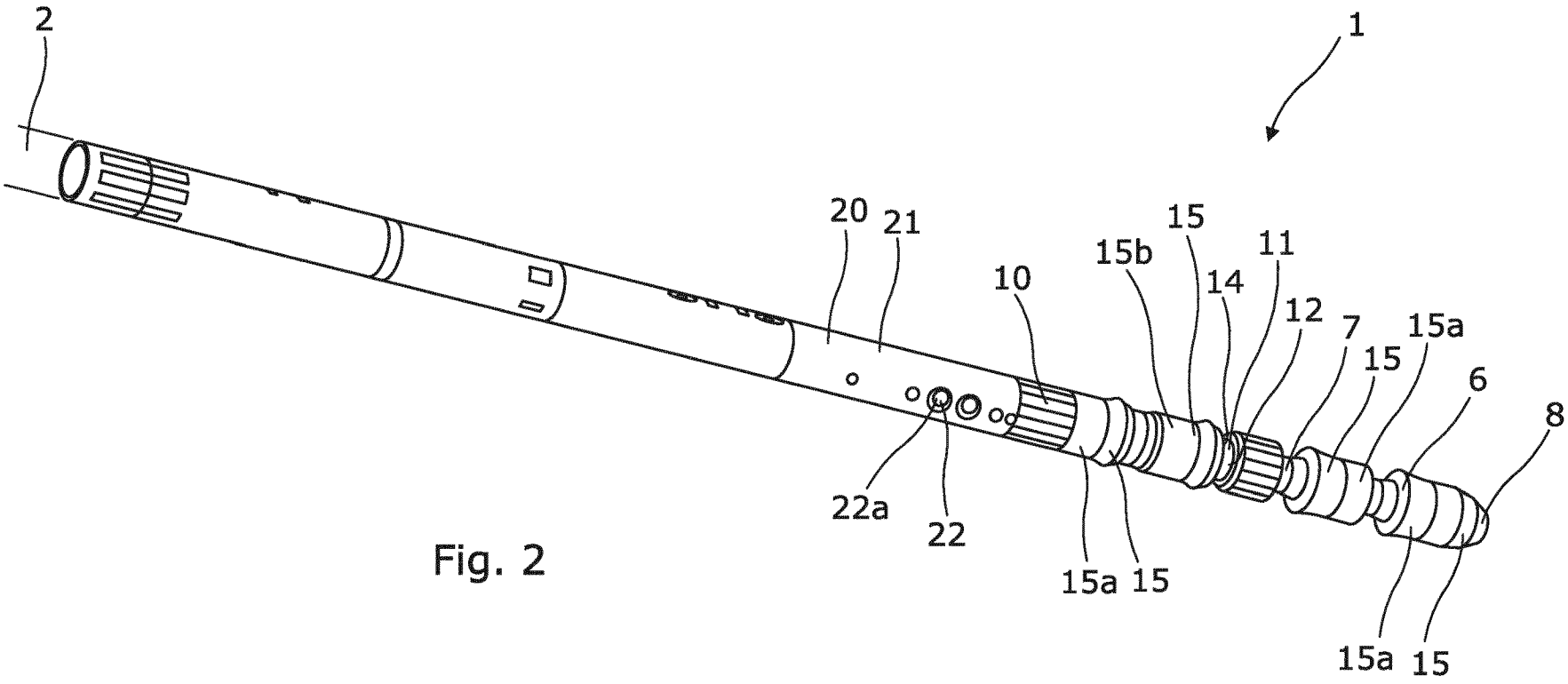
Figure 3:
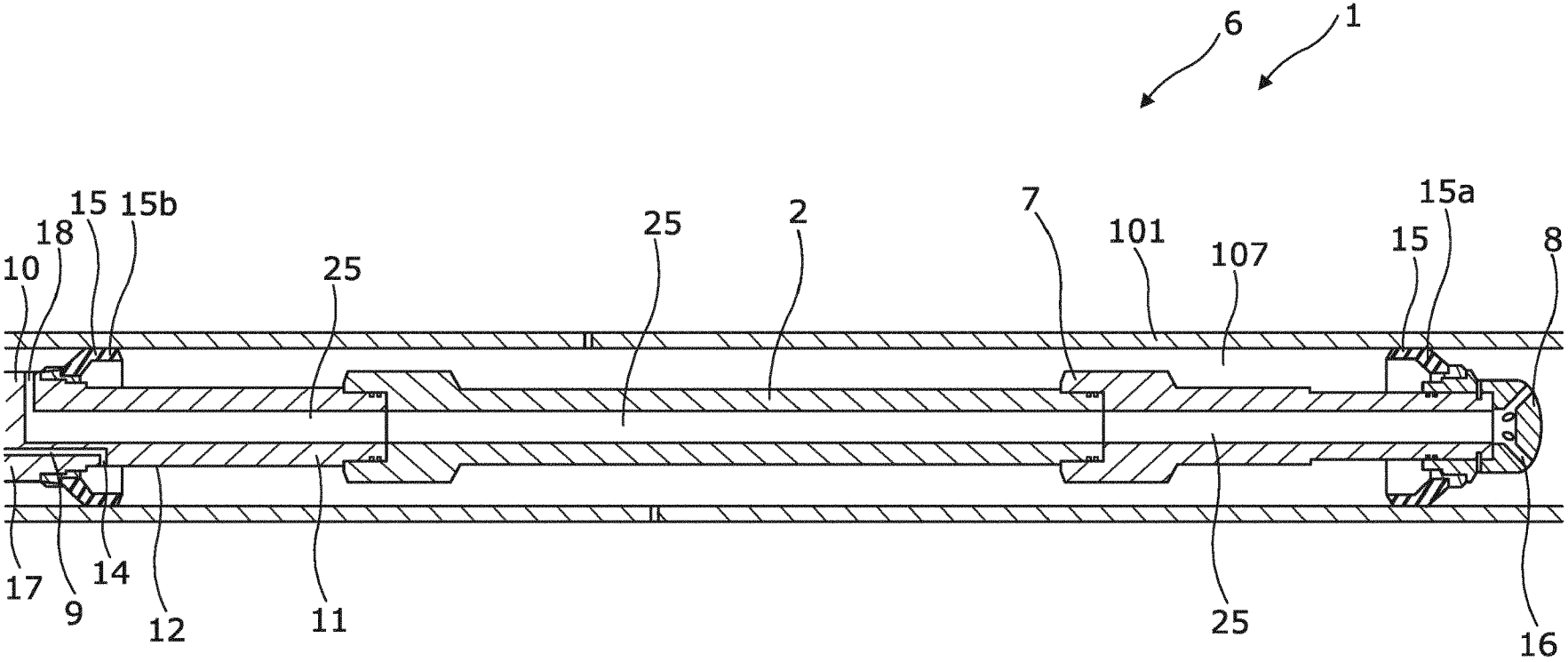
Figure 4:
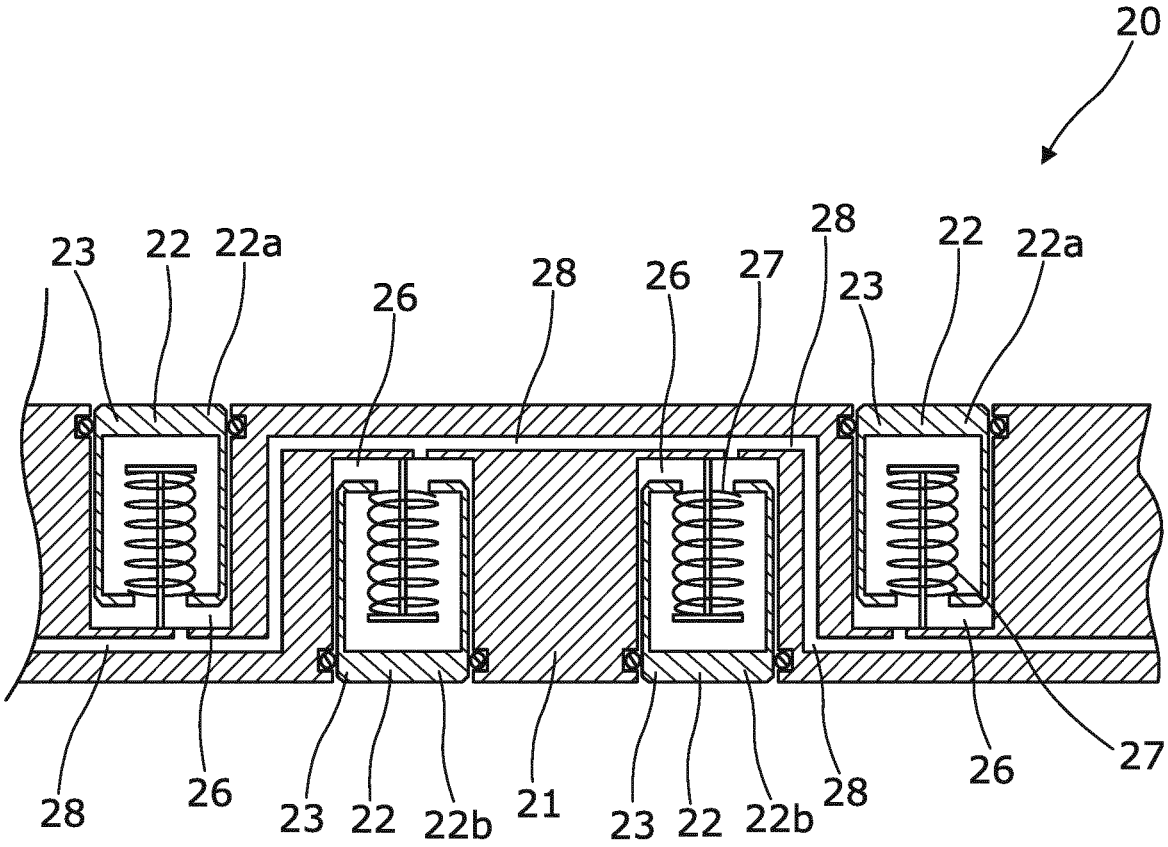
Figure 5A:
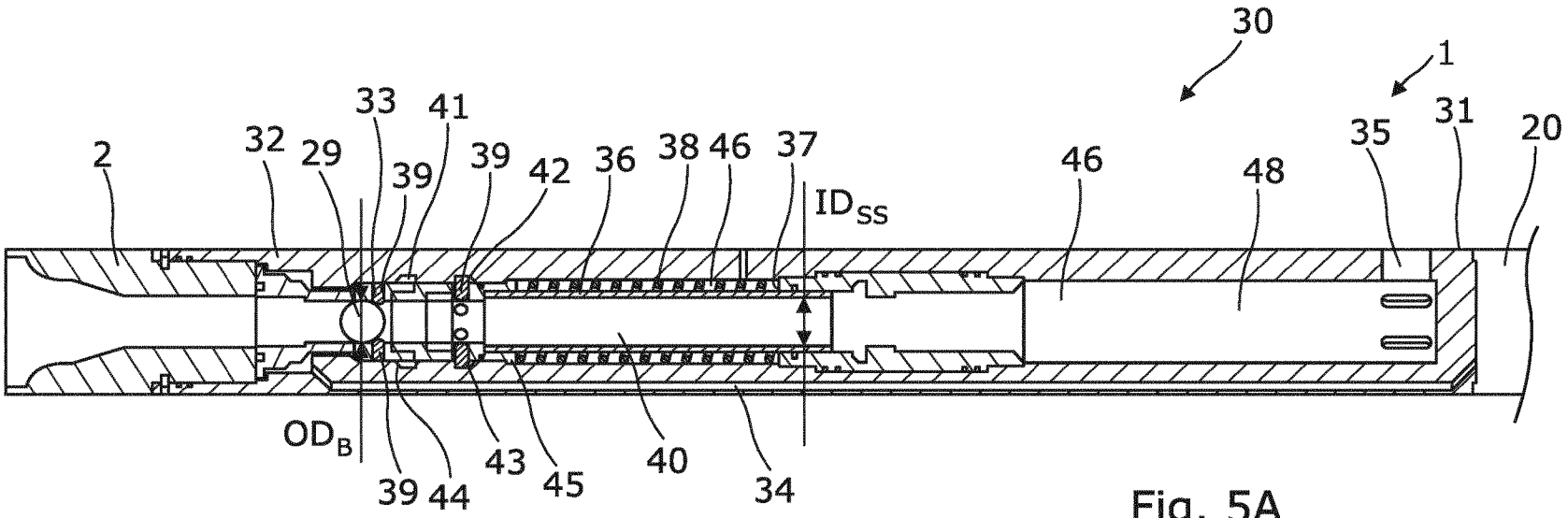
Figure 5B:
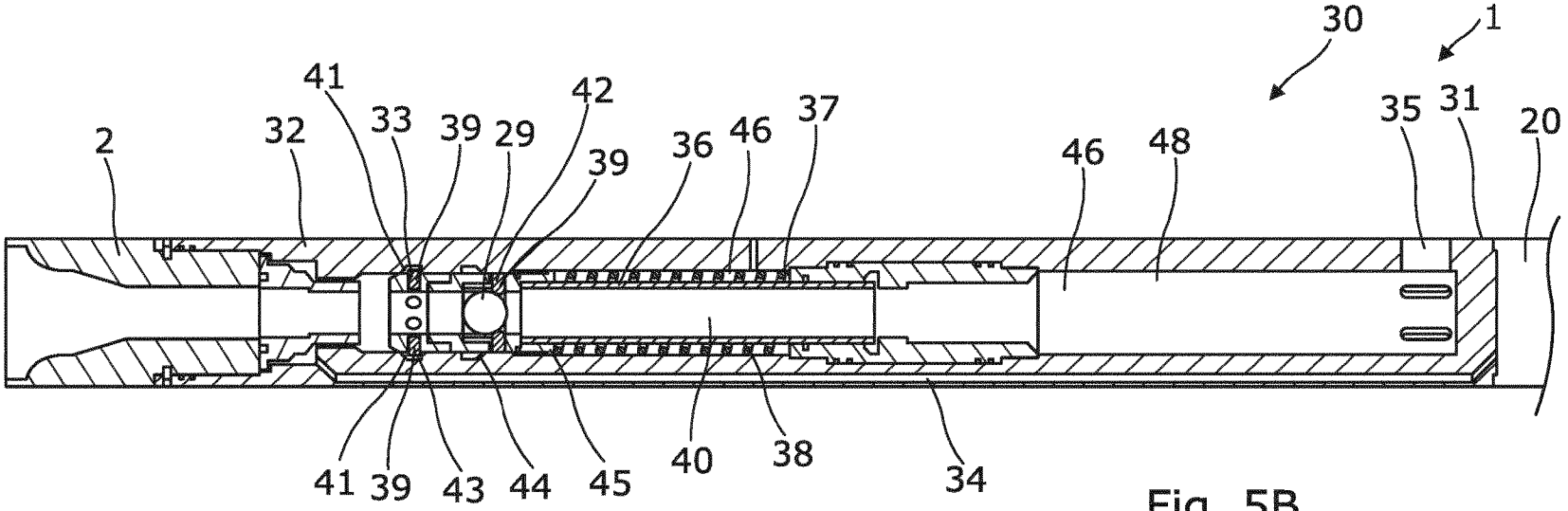
Figure 6:
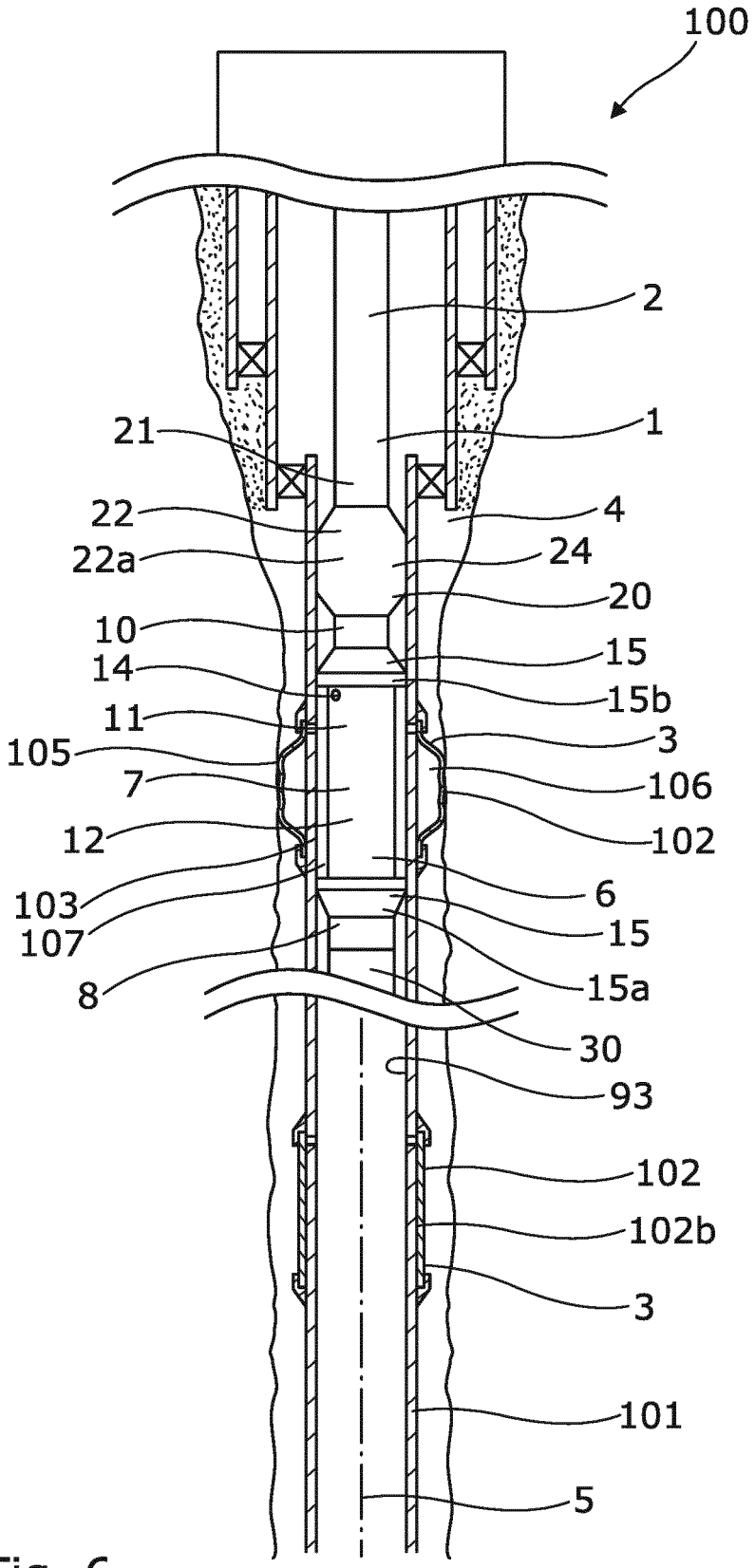
Figure 7:
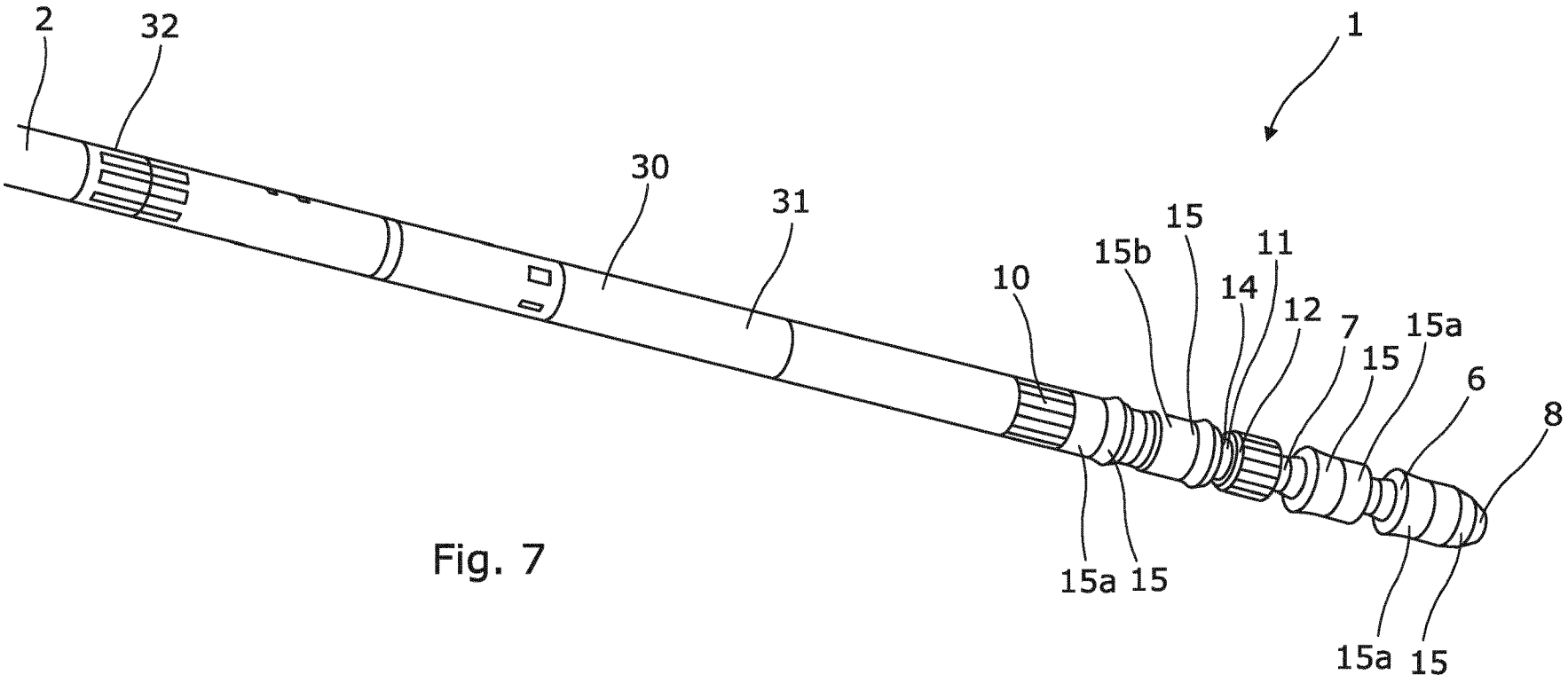
Figure 8:
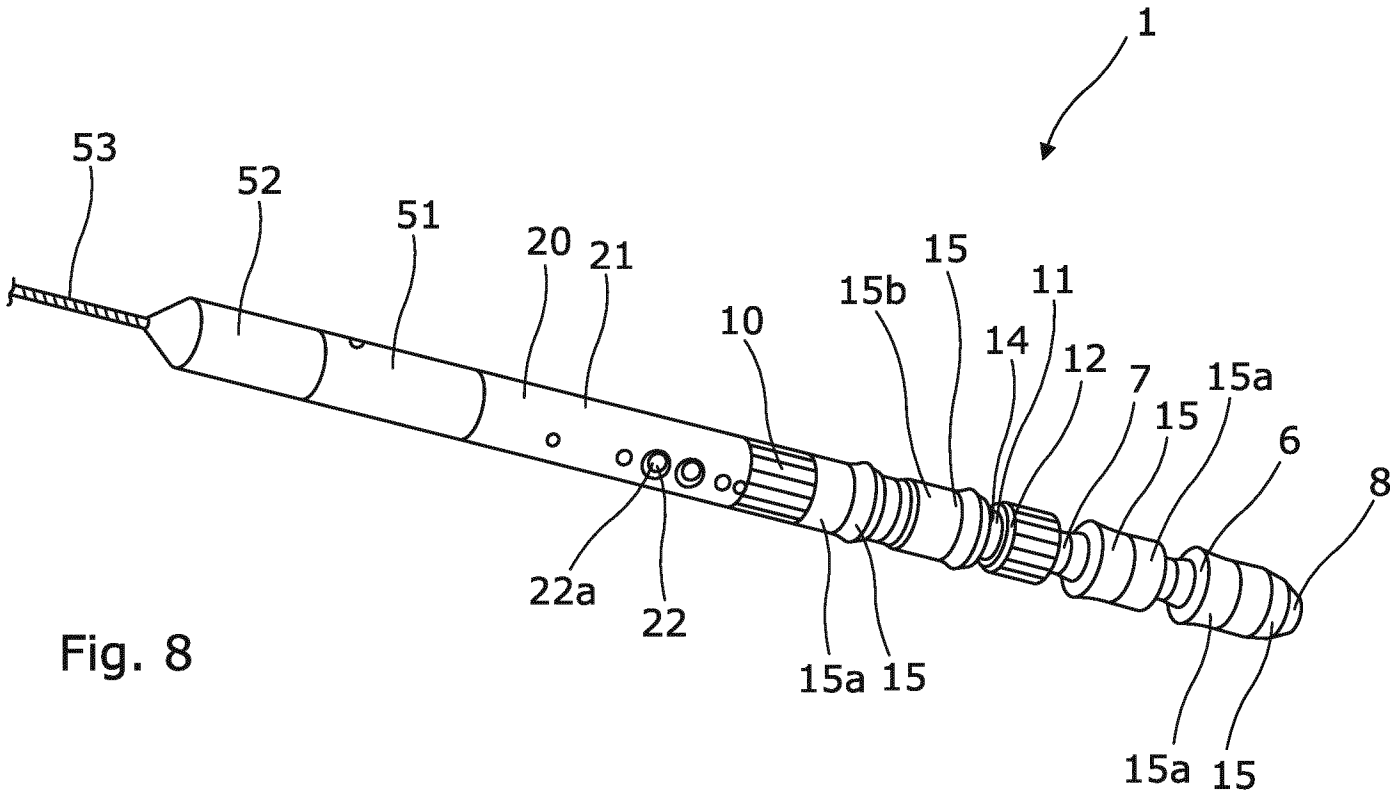
Figure 9:
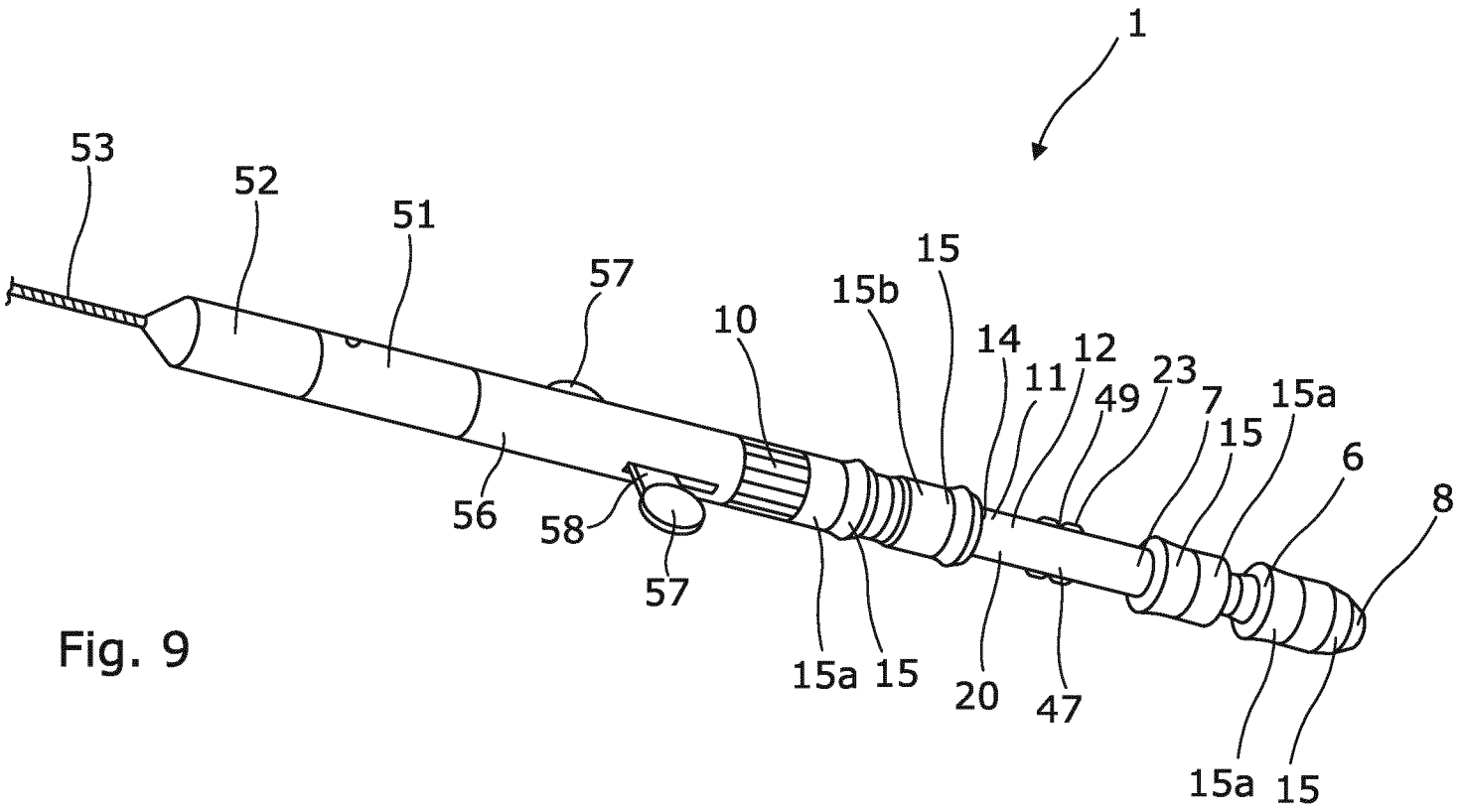
Figure 10:
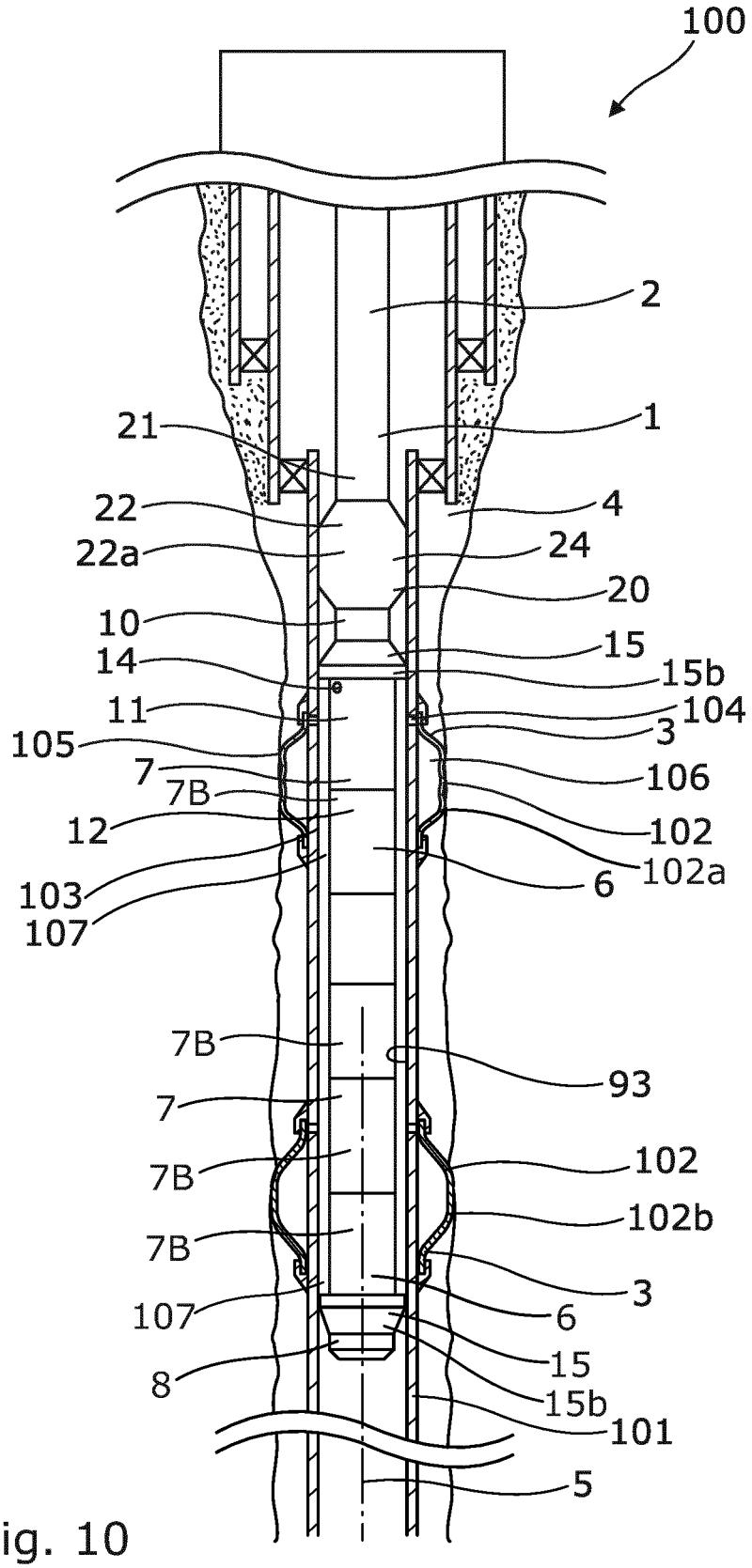

The invention and its many advantages will be described in more detail below with reference to the accompanying schematic drawings, which for the purpose of illustration show some non-limiting embodiments and in which FIG. 1 shows a partly cross-sectional view of a well comprising an expansion assembly, FIG. 2 shows a perspective view of an expansion assembly, FIG. 3 shows cross-sectional view of an expansion unit, FIG. 4 shows a cross-sectional view of a positioning unit, FIGS. 5A and 5B show a cross-sectional view of a ball catching unit, FIG. 6 shows a partly cross-sectional view of another downhole system, FIG. 7 shows a perspective view of another expansion assembly, FIG. 8 shows a perspective view of another expansion assembly, FIG. 9 shows a perspective view of yet another expansion assembly, and FIG. 10 shows a perspective view of another expansion assembly being a drill pipe expansion assembly.

All the figures are highly schematic and not necessarily to scale, and they show only those parts which are necessary in order to elucidate the invention, other parts being omitted or merely suggested.

FIG. 1 shows an expansion assembly 1 for connection with a drill pipe 2 for expansion of a completion component 3 in a well 4 having a longitudinal axis 5, comprising an expansion unit 6 and a positioning unit 20. The expansion unit 6 comprises a tubular element 7 comprising a first end 8 and a second end 10 and a wall 11 having an outer face 12 and an outlet 14 for ejection of pressurised fluid. The expansion unit 6 further comprises a first sealing element 15, 15*a* and a second sealing element 15, 15*b* arranged on the outer face on each side of the outlet. The positioning unit 20 comprises a body 21 and a first fixation element 22, 22*a* movable between a projected position and a retracted position in relation to the body. The positioning unit is connected with the second end of the tubular element in order to maintain the expansion unit in a position during expansion. The first fixation element 22, 22*a* is shown in its expanded and projected position.

By having a positioning unit connected to the expansion unit, the sealing elements are maintained in a predetermined position and thus not damaged compared to known expansion tools not having such positioning unit, and thus, the sealing elements do not have to be replaced at surface between two successive expansions of a completion component, and expansion of several completion components in one run is then made possible.

The positioning unit is fluidly connected with the drill pipe 2, and pressurised fluid in the drill pipe is supplied to the positioning unit in order to move the fixation element from the retracted position to the projected position. The positioning unit is furthermore fluidly connected with the outlet 14 of the expansion unit, so that pressurised fluid from the drill pipe flows into the positioning unit in order to move the fixation element to its projected position, and flows further into the expansion unit and out of the outlet to expand the completion component 3 which in FIG. 1 is an annular barrier 102. When the annular barrier is expanded, the expansion assembly retracts the fixation element and moves further down the well to expand the unexpanded annular barrier 102, 102*b* in order to expand the next completion component 3.

In FIG. 1, the sealing elements are cup seals enclosing an annular space 107 opposite the completion component to be expanded. As the annular space 107 is expanded, the cups are pressed further against the inner face 93 of the well tubular structure 101, sealing the annular space accordingly. Having been connected with a drill pipe, the expansion assembly is arranged in the well tubular structure, and the drill pipe is pressurised, and the pressurised fluid is led into the positioning unit to project the fixation element of the positioning unit, and the fluid is led further into the expansion unit and out through the outlet in the wall to expand the completion component.

In FIG. 2, the expansion unit comprises two first sealing elements 15, 15*a* and two second sealing elements 15, 15*b*, so that if one of the sealing elements arranged closest to the outlet 14 fails, there is a back-up sealing element arranged further away from the outlet 14.

The expansion unit of FIG. 3 comprises only one set of cups, and a fluid channel 9 in the wall 11 of the tubular element 7 is fluidly connected with the outlet 14 in order to provide fluid to the annular space 107 between the cups 15*a*, 15*b* and the well tubular structure 101. The positioning unit is fluidly connected with the outlet through the fluid channel 9 in the wall. The expansion unit 6 has a first opening 16 in the first end 8, and said first opening 16 is in fluid communication through an expansion bore 25 with a second opening 18 in an end part 17 arranged between the second end and the second sealing element 15, 15*b*. In this way, fluid bypass of the sealing elements 15, 15*a*, 15*b* is provided, so that when the expansion assembly is run in hole, the fluid in front of the expansion assembly 1 can freely flow through the expansion unit and thus not hinder the forward movement of the expansion assembly 1, and fluid bypass is also possible during expansion of the completion component.

As can be seen from FIG. 3, part of the tubular element 7 of the expansion unit 6 is a drill pipe and in this way, the expansion unit can straddle over several completion components, e.g. annular barriers, and expand several completion components in one pressurising step. The expansion assembly 1 is thus a drill pipe expansion assembly 1, as the drill pipe is used as part of the tubular element 7 for mounting the tubular element 7 in a certain length and thus varying the length of the drill pipe expansion assembly 1. And as shown in FIG. 10, the tubular element may be mounted from several drill pipe sections 7B, and the drill pipe expansion assembly 1 is thus able to straddle over both the first annular barrier 102, 102*a* and the second annular barrier 102, 102*b* in order to pressurise these two annular barriers substantially simultaneously. By having the tubular element 7 mounted from drill pipe sections 7B, the expansion assembly 1 can easily be prolonged at the rig, if the distance between two completion components, such as annular barriers, is longer than expected.

As shown in FIG. 4, the positioning unit 20 may comprise a second fixation element 22, 22*b* arranged opposite the first fixation element 22, 22*a*. In FIG. 4, the positioning unit 20 comprises two first fixation elements 22, 22*a* and two second fixation elements 22, 22*b*. In FIG. 4, the fixation elements are a projectable element 23, and in FIG. 1, the fixation element is an inflatable element 24. The projectable elements 23 of FIG. 4 are projectable to their projected position by pressurised fluid entering fixation chambers 26 into which the projectable elements 23 extend, and fixation springs 27 are compressed as the fixation elements move radially outwards by means of the pressurised fluid flowing in the fluid channels 28.

In FIGS. 5A and 5B, the expansion assembly further comprises a ball catching unit 30 having a first end 31 and a second end 32, and the first end of the ball catching unit is connected to the positioning unit 20 and the second end of the ball catching unit is connected to the drill pipe 2. The ball catching unit comprises a ball seat 33 in which a ball 29 is seated, as shown in FIG. 5A. The ball catching unit 30 further comprises a fluid bypass channel 34 which is in fluid communication with the positioning unit 20, so that the pressurised fluid bypasses the ball seat when the ball 29 seats in the first ball seat 33. The ball catching unit 30 further comprises an aperture 35 between the ball seat 33 and the positioning unit 20 near the first end 31 of the ball catching unit. The ball catching unit has a bore 46 between the aperture and the second end 32 of the ball catching unit 30. The ball catching unit 30 further comprises a sliding sleeve 36 comprising the ball seat 33 and being arranged within the bore 46. The aperture 35 is in fluid communication with the surrounding well fluid in the well tubular structure, so that when the sliding sleeve moves towards the first end 31, the fluid in the bore flows out of the aperture 35. An annular cavity 37 is arranged between the bore 46 and the sliding sleeve 36, in which annular cavity a spring 38 is arranged. The sliding sleeve 36 has a projection 45 for compressing the spring 38 as the sliding sleeve moves towards the aperture 35, as shown in FIG. 5B. The sliding sleeve has a sleeve bore 40 having an inner diameter $ID_{SS}$ which is larger than an outer diameter $OD_B$ of the ball.

As shown in FIG. 5A, the ball seat 33 is constituted by several pins 39 projecting radially inwards for catching the ball 29. The ball catching unit 30 has a first recess 41 configured to receive the pins as the sliding sleeve moves towards the aperture, as shown in FIG. 5B, and thus the pins are forced into the recess by means of the ball being pushed further towards the first end 31 by means of the pressurised fluid. The ball catching unit 30 also comprises a second ball seat 42 constituted by several pins 39 projecting radially inwards as the sliding sleeve moves towards the aperture 35. The pins of the second ball seat 42 are shown in their retracted position in FIG. 5A, where the pins 39 are retracted in a second recess 43, and in their projected position in FIG. 5B. Thus, the second recess 43 is configured to receive the pins of the second ball seat 42 as the sliding sleeve 36 moves away from the apertures 35. The recesses have an inclined face 44 for moving the pins radially inwards.

The ball catching unit 30 functions by a ball being dropped in the drill pipe, which ball lands on the pins of the first ball seat 33 in the sliding sleeve, and by means of the pressurised fluid, the sliding sleeve is moved in a bore in the first direction in order to compress the spring 38. The pins of the first ball seat 33 engage the first recess when the sliding sleeve 36 moves, and the ball 29 moves again and engages the pins of the second ball seat. Simultaneously, the pressurised fluid enters the expansion unit in order to expand the completion component. When the expansion of the completion component has ended, the pressure is somewhat released, and the spring 38 pushes the sliding sleeve in the second direction opposite the first direction, so that the pins of the second ball seat return into engagement with the recess 43 and the ball passes the pins of the second ball seat and moves further towards the aperture 35 into the ball catching chamber 48. The expansion assembly 1 is then ready to receive a second ball when the expansion assembly is arranged opposite the next completion component to be expanded. The second ball follows the same procedure as the first ball by being received firstly in the first ball seat 33 and then, as the sliding sleeve moves, in the second ball seat 42, and subsequently the second ball is received in the ball catching chamber 48.

By having a ball catching unit connected to the expansion unit, expanding several completion components in succession is then possible using a ball drop method.

The ball catching unit 30 is in FIGS. 5A and 5B arranged between the drill pipe 2 and the positioning unit 20, but may also be arranged so that the ball catching unit 30 is arranged in front of the expansion unit 6 and thus connected with the first end of the expansion unit 6, as shown in FIG. 6.

In FIGS. 5A and 5B, the positioning unit is supplied with pressurised fluid before the expansion unit, and when the pressure is reduced after expansion of the completion component, the fixation element is also retracted.

In FIG. 7, the expansion assembly 1 is connected with a drill pipe 2 for expansion of a completion component in a well, and the expansion assembly 1 comprises an expansion unit 6 and a ball catching unit 30. The expansion unit 6 comprises a tubular element 7 comprising a first end 8 and a second end 10 and a wall 11 having an outer face 12 and an outlet 14 for ejection of pressurised fluid. The expansion unit 6 further comprises a first sealing element 15, 15*a* and a second sealing element 15, 15*b* arranged on the outer face on each side of the outlet. The ball catching unit 30 has a first end 31 and a second end 32, the first end 31 of the ball catching unit 30 being connected to the second end 10 of the expansion unit 6 and the second end 32 of the ball catching unit 30 being connected to the drill pipe 2. The pressurised fluid in the drill pipe is then supplied to the ball catching unit 30 as described above, but the pressurised fluid by-passing the sliding sleeve is directly fed to the expansion unit.

The ball catching unit 30 may also be connected to the first end 8 of the expansion unit 6 and the second end of the ball catching unit 30 is connected to the drill pipe, and the ball is then passing the expansion bore 25 (shown in FIG. 3) of the expansion unit 6 before the ball is received in the first ball seat.

The ball catching unit 30 functions in the same way as described above, and the expansion assembly can be reused by dropping a second ball into the drill pipe.

In FIG. 6, the ball catching unit 30 may also be connected to the first end 8 of the expansion unit 6, and the ball then passes first the positioning unit 20 and then the expansion bore 25 (shown in FIG. 3).

In FIG. 8, the expansion assembly 1 is not connected with a drill pipe but with a wireline. The expansion assembly 1 comprises an expansion unit 6, a pump 51 and a motor 52, which is powered through wireline 53, for driving the pump, generating the pressurised fluid which is supplied to the expansion unit 6.

In FIG. 9, the expansion assembly 1 is connected with a driving unit 56, such as a downhole tractor having wheels 57 on projectable arms 58 for propelling the assembly forward in the well. The positioning unit 20 is a sleeve operating unit 47 having projectable elements 23 with a profile 49 configured to engage a profile in a sleeve. Thus, the expansion assembly 1 can first slide a sleeve for providing access through the well tubular metal structure and then pressurise the fluid channel in the tubular element for expansion of the completion component. The positioning unit is thus arranged in between the first sealing element and the second sealing element, so that the sleeve can be opened, and afterwards the expansion of the completion component can be initiated without having to move the expansion assembly. The sleeve operating unit 47 may thus keep the sleeve in an open position while expanding the completion component, and upon retracting the projectable arms 58, the sleeve automatically closes again. The expansion assembly 1 may further comprise a second positioning unit being an anchoring unit or the driving unit 56.

The downhole system 100, shown in FIG. 1, comprises a well tubular structure 101 and two annular barriers 102. Each annular barrier comprises a tubular part 103 having an expansion opening 104 and mounted as part of the well tubular structure, an expandable sleeve 105 surrounding and connected with the tubular part, and an expandable space 106 between the expandable sleeve and the tubular part. The expandable sleeve is expandable when pressurised fluid is let in through the expansion opening into the expandable space. The downhole system 100 further comprises an expansion assembly as described above and which is arranged in the well tubular structure, so that the first sealing element and the second sealing element are arranged on opposing sides of the expansion opening to provide an annular space 107 which is pressurised with pressurised fluid in order to expand the expandable sleeve.

A stroking tool may be used as a pressure intensifier and is a tool comprising a piston pump. The stroking tool comprises an electrical motor for driving the pump. The pump pumps fluid into a piston housing to move a piston acting therein. The piston is arranged on the stroker shaft. The pump may pump fluid into the piston housing on one side and simultaneously suck fluid out on the other side of the piston.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

The tubular part of the annular barrier may be a tubular metal part mounted as part of a well tubular metal structure and the expandable sleeve may be an expandable metal sleeve surrounding and connected to the tubular part defining the space.

By a well tubular structure is meant any kind of pipe, tubing, tubular, liner, string etc. used downhole in relation to oil or natural gas production.

In the event that the expansion assembly is not submergible all the way into the casing, a driving unit such as a downhole tractor can be used to push the expansion assembly all the way into position in the well. The downhole tractor may have projectable arms having wheels, wherein the wheels contact the inner surface of the casing for propelling the tractor and the expansion assembly forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. An expansion assembly for expansion of a fixed completion component located at a fixed position in a well having a longitudinal axis, the expansion assembly comprising:

an expansion unit which is moveable along the longitudinal axis in relation to the completion component prior to the expansion of the fixed completion component, comprising:

a tubular element comprising a first end and a second end and a wall having an outer face and an outlet for ejection of pressurised fluid, and a first sealing element and a second sealing element arranged on the outer face on each side of the outlet, and a positioning unit comprising a body and a first fixation element which is selectively and repeatably movable between a projected position and a retracted position in relation to the body, the positioning unit being connected with the tubular element in order to maintain the expansion unit in a fixed position in relation to the fixed completion component during expansion, wherein, in use, pressurized fluid initiates deployment of the first fixation element before reaching the outlet of the wall of the tubular element, and wherein the positioning unit is configured to be positioned at a first longitudinal position along the longitudinal axis and the expansion unit is configured to be positioned at a second longitudinal position along the longitudinal axis that is different than the first longitudinal position.

2. An expansion assembly according to claim 1, wherein the positioning unit is fluidly connected with a drill pipe and pressurised fluid in the drill pipe is supplied to the positioning unit in order to move the fixation element from the retracted position to the projected position.

3. An expansion assembly according to claim 1, wherein the positioning unit is fluidly connected with the outlet of the expansion unit.

4. An expansion assembly according to claim 1, wherein the positioning unit is a sleeve operating unit having projectable elements with a profile configured to engage a profile in a sleeve.

5. An expansion assembly according to claim 4, wherein the positioning unit is arranged in between the first sealing element and the second sealing element.

6. An expansion assembly according to claim 1, further comprising a ball catching unit having a first end and a second end, the first end of the ball catching unit being connected to the positioning unit and the second end of the ball catching unit being connected to a drill pipe.

7. An expansion assembly according to claim 6, wherein the ball catching unit further comprises a fluid bypass channel which is in fluid communication with the positioning unit, so that the pressurised fluid bypasses a ball seat.

8. An expansion assembly according to claim 7, wherein the ball catching unit further comprises an aperture between the ball seat and the positioning unit.

9. An expansion assembly according to claim 6, wherein the ball catching unit has a bore between an aperture and a second end of the ball catching unit.

10. An expansion assembly according to claim 9, wherein the ball catching unit further comprises a sliding sleeve comprising a ball seat and being arranged within the bore.

11. An expansion assembly according to claim 10, wherein an annular cavity is arranged between the bore and the sliding sleeve, in which annular cavity a spring is arranged, the sliding sleeve having a projection for compressing the spring as the sliding sleeve moves towards the aperture.

12. An expansion assembly according to claim 6, wherein the ball catching unit includes a ball seat constituted by several pins projecting radially inwards.

13. An expansion assembly according to claim 12, wherein the ball catching unit has a first recess configured to receive the pins as a sliding sleeve moves towards an aperture.

14. An expansion assembly according to claim 13, wherein the ball catching unit comprises a second ball seat constituted by several pins projecting radially inwards as a sliding sleeve moves towards the aperture, and the ball catching unit further comprises a second recess configured to receive the pins of the second ball seat as the sliding sleeve moves away from the aperture.

15. A downhole system comprising:

a well tubular structure, at least two annular barriers, each annular barrier comprising:

a tubular part having an expansion opening and mounted as part of the well tubular structure, an expandable sleeve surrounding and connected with the tubular part, and an expandable space between the expandable sleeve and the tubular part, the expandable sleeve being expandable when pressurised fluid is let in through the expansion opening into the expandable space, and an expansion assembly according to claim 1 arranged in the well tubular structure, so that the first sealing element and the second sealing element are arranged on opposing sides of the expansion opening to provide an annular space which is pressurised with pressurised fluid for expanding the expandable sleeve.

16. An expansion assembly according to claim 1, wherein the first fixation element is positioned at the first longitudinal position, axially spaced from the expansion unit.

17. An expansion assembly according to claim 1, wherein the expansion unit is positioned distally along the longitudinal axis relative to the positioning unit, such that the positioning unit is positioned in use closer to a head of the well compared to the expansion unit.

18. An expansion assembly according to claim 1, wherein, in use, the first fixation element is caused to retract after the fixed completion component has been expanded.

* * * * *